United States Patent [19]

Gaal et al.

[11] 4,280,659

[45] Jul. 28, 1981

[54] FUEL INJECTOR

[75] Inventors: Stephen L. Gaal; Gary L. Gant; George L. Muntean; Neville H. Reiners; Michael H. Shea, all of Columbus, Ind.

[73] Assignee: Cummins Engine Company, Inc., Columbus, Ind.

[21] Appl. No.: 59,543

[22] Filed: Jul. 23, 1979

[51] Int. Cl.[3] ..... B05B 9/00

[52] U.S. Cl. ..... 239/124; 239/533.9

[58] Field of Search ..... 239/124, 125, 533.2–533.5, 239/533.7–533.12, 88, 89, 90

[56] References Cited

U.S. PATENT DOCUMENTS

| | | | |
|---|---|---|---|
| 2,549,092 | 4/1951 | Huber | 239/125 |
| 2,890,657 | 6/1959 | May | 239/90 X |
| 3,351,288 | 11/1967 | Perr | 239/90 X |

*Primary Examiner*—Richard A. Schacher

*Attorney, Agent, or Firm*—Merriam, Marshall & Bicknell

[57] ABSTRACT

This disclosure relates to a unit-type fuel injector for an internal combustion engine such as a reciprocating piston internal combustion engine. The injector includes an injector body forming a plunger bore, and a plunger that reciprocates in the bore. A fuel supply passage and a drain passage are formed in the body, and a fuel injection chamber is formed at the lower end of the plunger bore. A feed hole connects the chamber with the supply passage, and a scavenge passage connects the supply and drain passages. During a retracted plunger, or fuel metering, portion of the injector cycle, the plunger opens the feed hole and closes the scavenge passage, and during a down plunger, or scavenging, portion of the injector cycle, the plunger closes the feed hole and opens the scavenge passage. An annular groove is formed between injector parts and surrounds the chamber, and the groove collects leakage. A restricted bleed hole connects the groove with the low pressure drain and removes the leakage. The feed hole is at an end of the supply passage, and the incoming fuel flows in a direct path through the supply passage and feed hole to the injection chamber.

10 Claims, 2 Drawing Figures

FUEL INJECTOR

Figure 1:
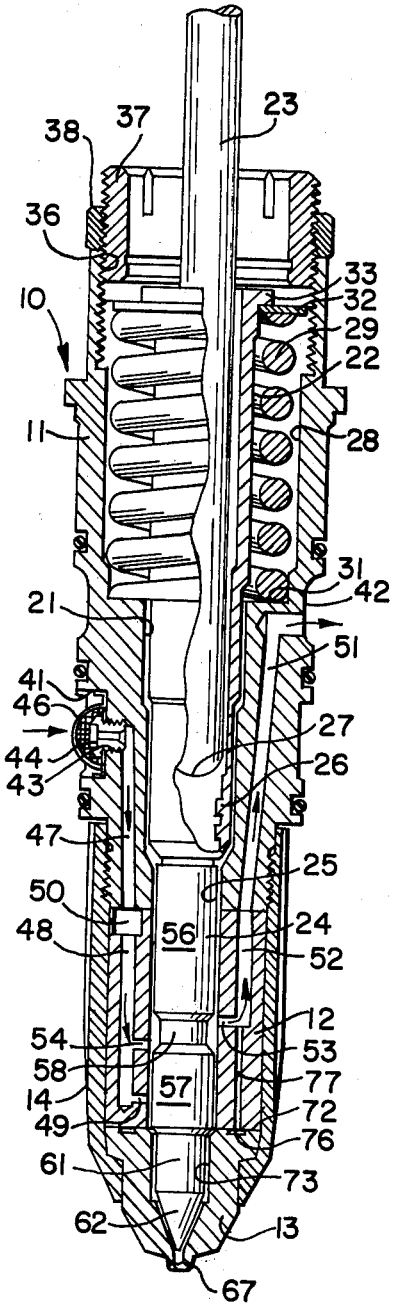

This invention deals with a fuel injector for an internal combustion engine, of the type including an injector body and a cam driven injector plunger. The body forms a fuel receiving chamber and the plunger is moved in the chamber to displace the fuel and inject it into an engine combustion chamber. Such an injector is shown in Perr U.S. Pat. No. 3,351,288 and with reference to FIG. 6 of this patent, the incoming fuel flows through a feed passage 97 and a feed hole 98 to an injection chamber 101. A restricted annular space 132 between a retainer 40 and a barrel 32 forms a scavenging fuel flow passage. In a commercial form of this injector, the fuel supply passages are formed generally as shown in FIGS. 2 to 6 of U.S. Pat. No. 3,831,846, and FIGS. 15 and 16 of U.S. Pat. No. 3,544,008. With reference to U.S. Pat. No. 3,831,846, the incoming fuel flows through a feed passage 168 to an annular groove 171 between an injector barrel 102 and a cup 66, and then upwardly to a feed hole 173 and a scavange hole 174.

While the commercial form of the injector has had wide commercial use for many years, it has certain disadvantages, particularly when operating at low fuel flow rates. Such low flow rates are encountered at light load, motoring and exhaust brake operating conditions, and carbon deposits may build up during such operation. When the plunger is moved upwardly in the retraction stroke, a relatively large amount of gas from the combustion chamber enters the injection chamber through the spray or sac holes, and a small amount of fuel enters the injection chamber through the feed hole. As will be described hereinafter, a small quantity of fuel is sucked into the injection chamber in each injector cycle even during motoring and exhaust braking conditions. Subsequent movement of the plunger in the injection stroke causes the gases to be highly compressed and heated, thereby greatly heating the small quantity of fuel in the injection chamber. This is disadvantageous because the heated fuel produces carbon deposits on the wall of the chamber and on the plunger tip. The slow moving fuel is additionally heated as it flows through the annular groove before entering the injection chamber, because the injector cup is heated by the combustion chamber. While the injector as shown in the patent has not been used commercially, it is believed that it would have a similar disadvantage.

Further, there is a possibility of leakage in both the commercial form and the patent form because the fuel may seep through the interface between the injector cut and the barrel. Any fuel reaching the space outside of the injector barrel eventually seeps into the combustion chamber and causes objectionable smoke.

It is a general object of the present invention to provide an improved injector that does not possess the foregoing disadvantages.

An injector in accordance with the present invention comprises an injector body including a barrel and a cup forming a fuel receiving injection or metering chamber. An injector plunger is movable in the chamber and displaces fuel from the chamber in an injection stroke, the fuel being ejected through sac holes and into an engine combustion chamber. A feed hole is formed in the barrel at a point which is spaced from the cup, and a fuel supply passage is formed in the barrel and leads directly to the feed hole. Scavenging passages are also formed in the barrel and are connected by a groove in the plunger, which connect the supply passage directly to a drain passage during part of the injector cycle. An annular groove is formed between the barrel and the cup, and a restricted leakage flow or bleed passage connects the annular groove with the return passage, thereby preventing fuel seepage to outside the barrel.

Figure 2:
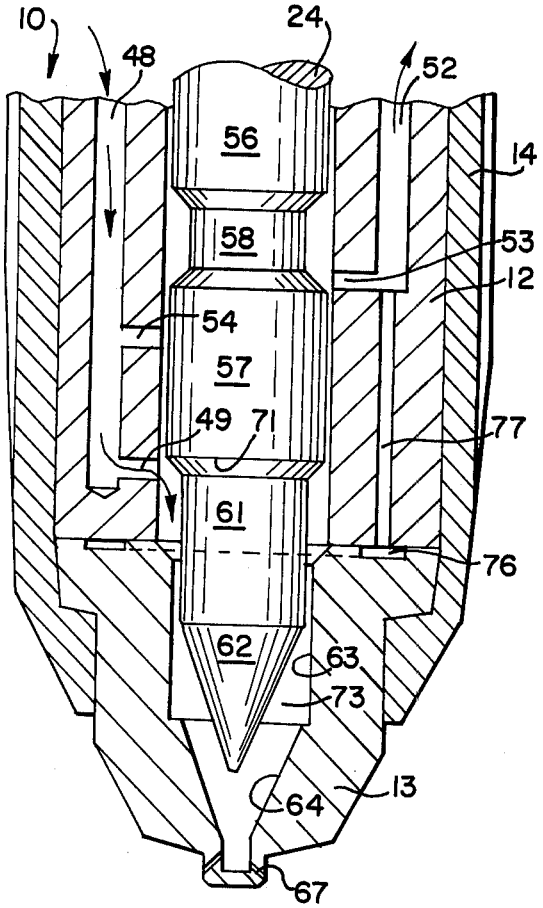

The foregoing and other objects and advantages of the present invention will become more apparent from the following detailed description taken in conjunction with the accompanying figures of the drawing, wherein:

FIG. 1 is a sectional view of an injector embodying the present invention; and FIG. 2 is a fragmentary enlarged view showing the injector in a different stage of its operation.

While the invention is described herein in connection with an injector for a multicylinder four-stroke diesel engine, it should be understood that the principles of the invention may also be applied to fuel injectors for other types of internal combustion engines.

With specific reference to FIG. 1, the injector 10 includes an injector body 11, a barrel 12, a cup 13 and a retainer 14. The body 11, barrel 12 and cup 13 are positioned in end-to-end relation with closely machined surfaces between them, and the retainer 14 extends around the barrel 12 and secures the cup 13 and the barrel 12 to the body 11. One or more dowels (not shown) may be provided between the body 11 and the barrel 12 to properly orient the fuel flow passages formed in these two parts.

The injector body 11 has a generally round tubular shape with a central hole 21 formed in it which receives a sleeve 22 and a link 23. The barrel 12 and the cup 13 have a plunger bore 25 formed in them which receives a plunger 24. The lower end of the sleeve 22 is secured to the upper end of the plunger 24 as by crimping in the area indicated by the numeral 26, and the sleeve 22 extends from the plunger 24 upwardly to adjacent the upper end of the body 11. The link 23 extends through the sleeve 22 and engages a cup or socket 27 formed in the upper end of the plunger 24. Thus, a downward force on the link 23 is transferred directly to the upper end of the plunger 24.

The upper end of the hole 21 is enlarged as indicated at 28, and a return spring 29 is mounted in the enlargement 28. The lower end of the return spring 29 is positioned on a ledge 31 and the upper end of the spring 29 engages a washer 32. The washer 32 is held between the upper end of the spring 29 and a flange 33 on the upper end of the sleeve 22. Thus, the return spring 29 urges the washer 32, the sleeve 22 and the link 23 upwardly, and thereby tends to move the plunger 24 upwardly. The upper end of the injector body 11 is internally threaded as indicated at 36 and a top stop 37 is threaded into the injector body 11. A lock nut 38 secures the stop 37 at a selected position. The stop 37 overlies the washer 32 and forms a stop which limits the upward movement of the washer 32 and the parts connected to it.

The injector body 11 has a fuel inlet groove 41 and a drain groove 42 formed in its outer periphery, and the injector is designed for installation in an engine wherein the head (not shown) has a common fuel supply rail and a common return rail formed in it. The two rails connect with the grooves 41 and 42. A fuel supply opening 43 is formed in the injector body 11 and opens into the supply groove 41 and a metering plug 44 is mounted in the opening 43. A screen 46 is preferably provided over the opening 43 to prevent impurities from entering the injector. A fuel supply passage 47 extends from the opening 43 and longitudinally downwardly within the injector body 11 to the lower end of it. At the upper end of the barrel 12 is formed another fuel supply passage 48 including a check valve arrangement 50 that permits flow of the fuel only in the direction that is away from the opening 43. The supply passage 48 in the barrel 12 extends to a point which is spaced from the interface 72 between the cup 13 and the barrel 12, and a radial metering orifice 49 connects the lower end of the supply passage 48 to the plunger bore 25 in the barrel 12.

The return groove 42 in the injector body 11 connects with a drain or return passage 51 which is formed longitudinally in the injector body 11 from the groove 42 downwardly to the lower face of the body. A connecting drain passage 52 is formed in the barrel 12 and communicates with a drain port 53 that opens into the plunger bore 25. The drain port 53 is on the side of the barrel 12 that is opposite from a scavenge port 54 that is connected to the supply passage 48. As shown, the ports 53 and 54 are displaced upwardly, or in the direction of the injector body 11, from the metering orifice 49.

As previously mentioned, the plunger 24 is movably mounted in the plunger bore 25 formed in the barrel 12, and the plunger 24 includes running surfaces 56 and 57 which have a close sliding fit with the bore surface. The clearances between the bore surface and the plunger are greatly exaggerated in the drawings. The two running surfaces 56 and 57 are separated by a top or scavenging groove 58 formed in the plunger 24. The two ports 53 and 54 are axially separated and the groove 58 has an axial dimension sufficiently long to connect the two ports 53 and 54 when the plunger 24 is in the downward displaced position illustrated in FIG. 1. Consequently, in the position illustrated in FIG. 1, the fuel flows from the supply passages 48 and the scavenge port 54, through the groove 58, the drain passage 52 and to the return rail. However, when the injector plunger 24 is in the retracted or upwardly displaced position illustrated in FIG. 2, the scavenge port 54, which is downwardly displaced from the drain port 53, is closed by the lower running surface 57, which prevents the flow of scavenging fuel.

The lower end of the plunger 24 has a reduced or minor diameter portion 61 and a cone portion 62 formed at its lower end. The cup 13 has a chamber formed by a cylindrical upper part 63 and a cup seat 64. The cylindrical portion 63 has a slightly larger diameter than the minor diameter part 61 of the plunger, and the cone 62 is shaped to mate with the cup seat 64. At the lower end of the cup 13, a plurality of sac holes 67 are formed through the wall of the cup 13 and connect the interior chamber of the cup 13 with the engine combustion chamber.

Where the lower running surface 57 meets the minor diameter portion 61 of the plunger 24, there is formed a control edge 71 which, when the plunger 24 is in the retracted position, is slightly above the metering orifice 49. When the plunger 24 is in the downwardly displaced position shown in FIG. 1, the control edge 71 is at approximately the level of the interface 72 between the barrel 12 and the cup 13. The portion of the bore 25 below the control edge 71 forms a fuel injection or metering chamber 73, which is bounded by surfaces of the cup 13, and the lower end of the barrel 12, and the exterior surface of the plunger 24 below the edge 71. When the plunger is in the upwardly displaced position shown in FIG. 2, fuel is able to flow from the supply passage 48, through the metering orifice 49 and into the metering chamber 73. Of course, when the plunger 24 is displaced downwardly during an injection stroke of the plunger, the edge 71 closes off the metering orifice 49 and traps the fuel in the metering chamber 73, and the continued downward movement of the injector plunger 24 displaces the fuel out of the chamber 73 and ejects it through the sac holes 67. The check valve arrangement 50 normally prevents any reverse flow of fuel from the passage 48 to the passage 47.

During an injection stroke as described above, the fuel in the metering chamber 73 is placed under high pressure, and it is possible for some leakage to occur from the chamber 73 through the interface 72 between the barrel 12 and the cup 13. An annular groove 76 is formed at the interface 72, and in the present instance the groove is formed in the upper surface of the cup 13. Any leakage through the interface 72 is collected in the groove 76, and a restricted or relatively small diameter vent or bleed passage 77 is formed longitudinally of the barrel 12, which connects the groove 76 with the drain passage 52. Thus any leakage accumulated in the groove 76 is bled off through the passage 77 to the drain 52.

It is a feature of the present invention that the bleed passage 77 has a relatively small diameter. When the plunger 24 moves downwardly in an injection stroke, the fuel in the chamber 73 is placed under extremely high pressure, and a high pressure pulse is transmitted through the interface 72 to leakage fuel in the groove 76. The small or restricted size of the passage 77 prevents this pressure pulse from being transmitted to the passage 52. Such a pulse appearing at the port 53 would move through the groove 58 and the feed passage 48. In certain circumstances, the pulse would be transmitted to the orifice 49, and also through the check valve 50 to the common fuel supply rail and interfere with the operation of other injectors of the engine. However, the small diameter of the passage 77 produces a sufficient pressure drop to prevent problems as outlined above. As a specific example of the sizes of the passages, the diameter of the passages 48 and 52 may be approximately 0.080 to 0.095 inch and the diameter of the passage 77 may be approximately 0.020 inch.

Summarizing the operation of the injector, assume that the engine is operating under average load conditions and that the injector plunger 24 is in the position illustrated in FIG. 2 where the surface 57 closes the scavenage port 54 and the edge 71 is above the metering orifice 49. Fuel flows through the supply passage 48 and the metering orifice 49 and into the metering chamber 73, and the quantity of fuel flowing into the metering chamber 73 during each injector cycle is a function of the pressure of the fuel in the fuel supply rail and of the length of time the plunger 24 is in the retracted position (the latter factor being a function of the engine speed). At the end of the metering portion of the injector cycle, the engine cam drive mechanism (not illustrated) drives the link 23 and the plunger 24 downwardly in an injection stroke of the injector. The edge 71 closes the metering orifice 49 and traps the fuel in the metering chamber 73, and the lower edge of the groove 58 opens the scavenge port 54. Opening of the port 54 permits scavenge fuel flow from the supply passage 48, through the groove 58 and out of the injector through the drain passage 52. As the plunger 24 moves downwardly, it exerts pressure on the fuel trapped in the chamber 73 and displaces the fuel from the chamber and out of the holes 67. Any leakage fuel seeping through the interface 72 is collected in the groove 76 and returned through the bleed passage 77 to the drain passage 58, but high pressure pulses are prevented.

When the plunger 24 subsequently moves upwardly in the retraction stroke, a suction is created in chamber 73 which tends to suck fuel out of the orifice 49 and exhaust gases through the spray holes 67. Exhaust gases are also forced into the chamber 73 during the compression stroke of the engine piston. In the next injection stroke of the plunger, the gases in the chamber 73 are highly compressed and heated, but during average engine load operation, the amount of fuel flowing into the chamber 73 in each cycle is sufficient to cool the lower tip portion of the plunger 24.

During motoring or exhaust brake operation of the engine, the amount of fuel metered into the chamber 73 should be at a minimum. At the start of such operation, the passage 48 down to the orifice 49 is filled with fuel, and the first retraction stroke of the plunger causes the fuel at the lower end of the passage 48 to be sucked into the chamber 73. In subsequent injection strokes during such operation, a short column of exhaust gas is pumped back and forth at the lower end of the passage 48, which prevents additional fuel from entering the chamber 73. Consequently, carboning is prevented because of the lack of fuel, and noxious emissions are reduced because fuel is not dribbled into the chamber 73 and then into the engine combustion chamber.

The operation discussed in the foregoing paragraph differs from that of commercial form of the injector described previously, and it is believed that it also would differ from the injector shown in U.S. Pat. No. 3,351,288. In the prior art forms described, the injector passage extends vertically in both directions from the metering orifice, and the passage is normally filled with fuel. A gas column may form in the portion of the passage which is above the metering orifice, but fuel will be sucked into the metering chamber in each injector cycle from the portion of the passage which is below the orifice. This small amount of fuel sucked into the metering chamber in each cycle is heated to a very high temperature by the compression of the exhaust gas during the injection stroke, resulting in carbon deposits on the surfaces of the plunger and the metering chamber. The fuel also dribbles into the combustion chamber and causes emission problems. Carbon deposits interfere with the injector operation and the proper metering of fuel.

It will be apparent from the foregoing that the fuel flowing into the injector is connected by a relatively short direct path to the metering chamber 73. The metering orifice is at the lower end of a fuel supply passage and it is spaced from the injector cup. Therefore the problem of carboning of the injector surfaces within the chamber 73 and on the plunger tip is substantially reduced or eliminated. Further, the arrangement of the groove 76 and the restricted bleed passage 77 prevents fuel leakage and pressure pulses. A barrel 12 in accordance with this invention is highly advantageous because it includes the features of the invention and it may be substituted for the barrel of the previously described commercial injector and used in combination with the other injector parts of the commercial injector.

We claim:

1. In a fuel injector for an internal combustion engine, the improvement of a generally cylindrical barrel having a longitudinal axis, said barrel having an axially extending plunger bore formed therethrough, a fuel supply passage and a drain passage formed in said barrel, said supply and drain passages extending generally axially and being radially spaced from said bore, said supply passage extending from one end of said barrel to a barrel location that is spaced from the other end, a generally radially extending feed hole at said barrel location and connecting said supply passage with said bore, a first generally radially extending scavenging hole in said barrel and connecting said supply passage with said bore at a barrel location that is between said one end and said feed hole, a second generally radially extending scavenging hole in said barrel generally adjacent said first scavenging hole and connected with said bore, and said drain passage extending from said end and connecting with said second scavenging hole.

2. Apparatus as in claim 1, wherein said barrel further has a bleed passage formed therein, said bleed passage extending from said outer end of said barrel and connecting with said drain passage.

3. Apparatus as in claim 2, wherein said bleed passage has a restricted flow area.

4. Apparatus as in claim 2, wherein the flow area of said bleed passage is substantially smaller than the flow areas of said supply and drain passages.

5. In a fuel injector for an internal combustion engine, the improvement of a generally cylindrical barrel having a longitudinal axis, said barrel having an axially extending plunger bore formed therethrough, a fuel supply passage and a drain passage formed in said barrel, said supply and drain passages extending generally axially and being radially spaced from said bore, said supply passage extending from one end of said barrel, a generally radially extending feed hole connecting said supply passage with said plunger bore, a first generally radially extending scavenging hole connecting said supply passage with said bore at a barrel location that is between said one end and said feed hole, a second generally radially extending scavenging hole in said barrel generally adjacent said first scavenging hole, said drain passage extending from said one end and connecting with said second scavenging hole, and a restricted bleed passage formed in said barrel and extending from said other end and connecting with said drain passage.

6. Apparatus as in claim 5, wherein said bleed passage has a substantially smaller flow area than said supply and drain passages.

7. In a fuel injector for an internal combustion engine, the improvement comprising a barrel, an injector cup fastened to an end of said barrel, said barrel and said cup having a plunger bore formed therein adapted to receive a plunger, said barrel and said cup having engaging surfaces and a groove formed in at least one of said surfaces, said groove extending around said plunger bore, said barrel having a drain passage formed therein, and said barrel further having a bleed passage formed therein and connecting said groove with said drain passage.

8. Apparatus as in claim 7, wherein said barrel further has a fuel supply passage and a feed passage formed therein, said feed passage connecting said supply passage with said plunger bore, and said supply passage and said feed passage being spaced from said groove.

9. Apparatus as in claim 8, wherein said barrel further has scavenge passages formed therein for selectively connecting said supply and drain passages, and said bleed passage has a relatively small flow area compared with the flow areas of said supply and drain passage.

10. Apparatus as in claim 7, wherein said barrel has one end thereof engaging said cup, said barrel further having a fuel supply passage therein extending from the other end toward but being spaced said one end, and said barrel further having a feed passage connecting said supply passage with said plunger bore, said feed passage being closely adjacent the end of said supply passage which is adjacent said one end.

* * * * *